US006090450A

United States Patent [19]

Kahmann et al.

[11] Patent Number: 6,090,450

[45] Date of Patent: Jul. 18, 2000

[54] METHOD AND APPARATUS FOR SPRAY COATING A WORKPIECE

[75] Inventors: Ralf Kahmann, Heusenstamm; Udo Klein, Dietzenbach; Winfried Ott, Rodgau; Volker Weiss, Frankfurt, all of Germany

[73] Assignee: LacTec GmbH Gesellschaft fuer Moderne Lackiertechnik, Rodgau, Germany

[21] Appl. No.: 09/244,928

[22] Filed: Feb. 4, 1999

[30] Foreign Application Priority Data

Feb. 13, 1998 [DE] Germany ..... 198 05 938

[51] Int. Cl.[7] ..... B05D 1/02

[52] U.S. Cl. ..... 427/421; 118/302; 222/148; 239/113; 239/119

[58] Field of Search ..... 427/421; 118/302; 239/419, 419.3, 427.5, 112, 113, 116; 222/148, 334

[56] References Cited

U.S. PATENT DOCUMENTS

| | | | |
|---|---|---|---|
| 2,965,114 | 12/1960 | Harden . | |
| 4,311,724 | 1/1982 | Scharfenberger . | |
| 5,192,595 | 3/1993 | Akeel et al. | 427/421 |
| 5,221,047 | 6/1993 | Akeel . | |
| 5,289,947 | 3/1994 | Akeel et al. . | |
| 5,326,031 | 7/1994 | Konieczynski . | |
| 5,582,350 | 12/1996 | Kosmyna et al. . | |

FOREIGN PATENT DOCUMENTS

| | | |
|---|---|---|
| 3927880 | 1/1991 | Germany . |
| 4133840 | 4/1993 | Germany . |
| 4342128 | 6/1995 | Germany . |

*Primary Examiner*—Shrive Beck
*Assistant Examiner*—Jennifer Calcagni
*Attorney, Agent, or Firm*—W. F. Fasse; W. G. Fasse

[57] ABSTRACT

An apparatus and method for painting a workpiece while switching paint colors between successive painting cycles includes a paint supply switching device, a paint feed line connected to the paint supply switching device, a separating element adapted to move back and forth in at least a portion of the paint feed line, first and second receiver stations adapted to receive the separating element at the end positions of its travel in the paint feed line, and a paint spray nozzle at a terminal end of the paint feed line. The separating element is actively held in the first receiver station while paint of a first color is supplied through the paint feed line and sprayed from the nozzle onto a workpiece. To switch to a paint of a second color, the supply of the first paint is terminated, the separating element is released from the first receiver station, and a pushing medium pushes the separating element through the paint feed line, while residual paint is pushed from the paint feed line out through the spray nozzle. The separating element forms a sealing barrier between the pushing medium and the residual paint. Sensors detect the arrival of the separating element in the second receiver station, and the flow of pushing medium is terminated to avoid spraying the pushing medium out through the spray nozzle. Then a pushing medium pushes the separating element back into the first receiver station.

15 Claims, 1 Drawing Sheet

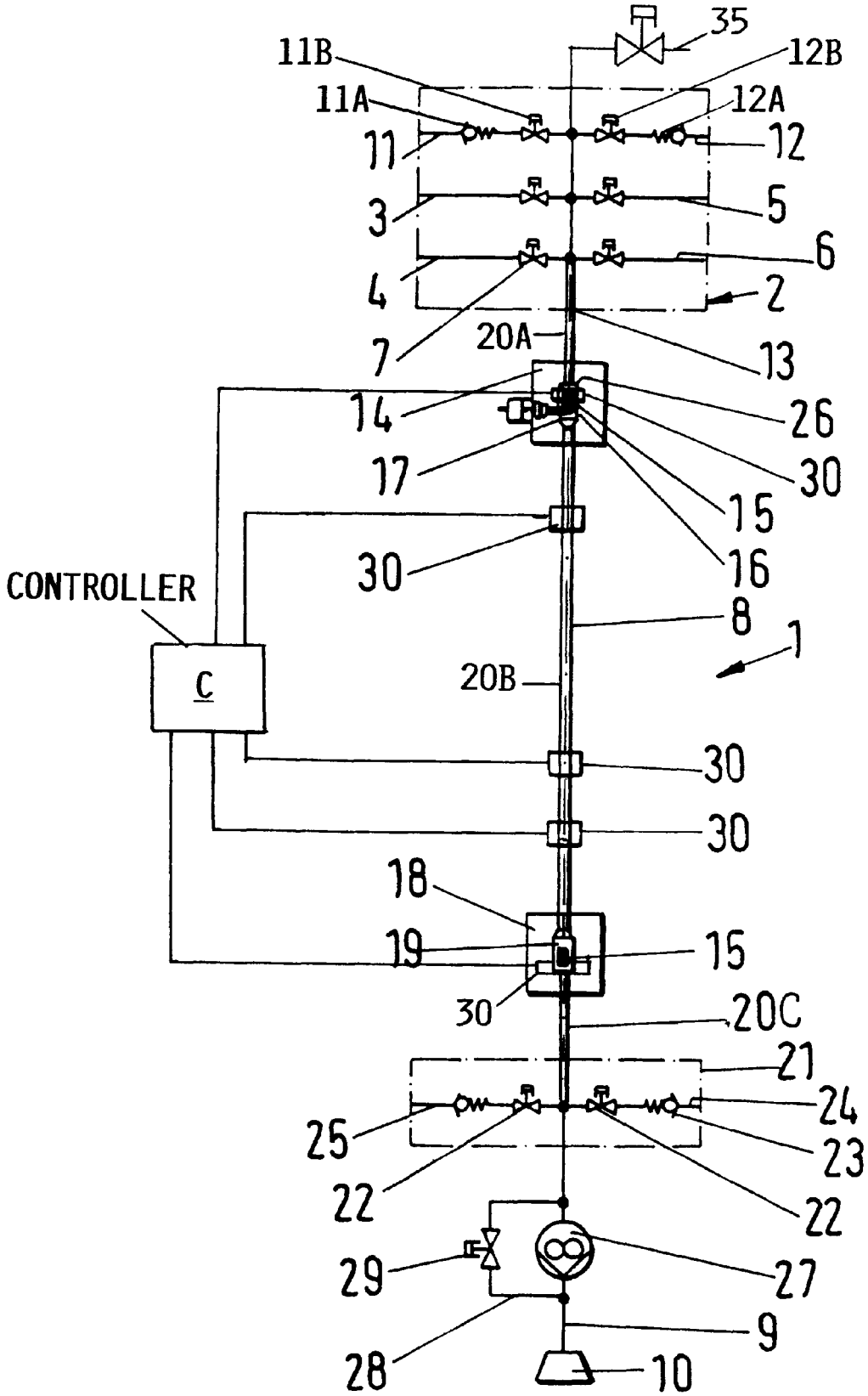
35
11B
12B
11A
12A
11
12
3
5
6
4
2
7
20A
13
14
26
17
30
15
16
30
CONTROLLER
8
1
C
20B
30
30
18
19
15
30
20C
21
24
25
23
22
22
29
27
9
28
10

METHOD AND APPARATUS FOR SPRAY COATING A WORKPIECE

CROSS-REFERENCE TO RELATED APPLICATION

This application is related to our copending application U.S. Ser. No. 09/105,505, filed on Jun. 26, 1998, and entitled "PAINT SPRAYING EQUIPMENT AND METHOD OF CLEANING THE SAME". The entire disclosure of U.S. application Ser. No. 09/105,505 is incorporated herein by reference.

PRIORITY CLAIM

This application is based on and claims the priority under 35 U.S.C. §119 of German Patent Application 198 05 938.8, filed on Feb. 13, 1998, the entire disclosure of which is incorporated herein by reference.

FIELD OF THE INVENTION

The invention relates to a method and an apparatus for spraying paint or another coating material onto a series of workpieces, with switching of the coating material, e.g. switching to a different color of paint, between successive coating application cycles.

BACKGROUND INFORMATION

A method and an apparatus of the above mentioned general type are known in the art, for example as disclosed by U.S. Pat. No. 4,311,724 (Scharfenberger), particularly in relation to equipment for carrying out automatic finish coating such as finish painting, with frequent changes of the paint color. The known painting equipment includes a plurality of different paint supplies that are selectively connectable to a paint feed line or feed tube to convey the selected color of paint to an atomizing spray nozzle. Before a change of the paint color is to be carried out, for example during the finish painting of the body of a motor vehicle, pressurized air having a relatively low pressure is introduced into the feed tube to push at least a portion of the residual paint present in the feed tube toward and then out through the spray nozzle. In this manner, at least a portion of the residual paint that was in the feed tube can be used for carrying out the paint spraying process in the usual manner, so as to reduce the wasting of paint when carrying out a paint color change.

However, the above known method cannot be satisfactorily carried out in many cases, because the paint pushing medium, or particularly the pressurized air, does not remain positively and physically exactly separated from and behind the column of residual paint in the feed tube. Such separation would be necessary to ensure that pure paint is provided to the spray nozzle for as long as possible, i.e. to remove the greatest amount of residual paint possible from the feed tube while still being able to carry out normal spraying without contamination or irregularities. It also is not possible in the known equipment to accurately stop the spraying operation at the last moment, so as to avoid spraying the pushing medium out through the nozzle. Instead, the paint pushing medium or particularly pressurized air mixes and intermingles with the residual paint, such that complete removal or extraction of the residual paint from the feed tube is not possible, and there is a danger that a mixture of the paint and the pushing medium will be sprayed out through the nozzle. Since it is thus impossible to determine exactly how much useable paint remains in the feed tube, a majority or at least a large proportion of the residual paint remains unused and must later be flushed out of the paint tube, to ensure a reliable type-pure painting process.

SUMMARY OF THE INVENTION

In view of the above, it is an object of the invention to provide a method and an apparatus for carrying out the spray application of paint or other coating materials while changing the color or other characteristics of the coating material in successive paint application cycles, using a pushing medium to push the residual paint out of the paint feed line at the end of a given paint application cycle and reliably separating the pushing medium from the residual paint that is to be used for normal painting spray application. The invention further aims to avoid or overcome the disadvantages of the prior art, and to achieve additional advantages, as apparent from the present specification.

The above objects have been achieved according to the invention in a method for changing the paint in a paint feed line leading from a paint color switching device to an atomizing spray nozzle, comprising the following steps and features. Before the end of a given paint application cycle, the method includes a step of stopping the supply flow of a first paint and instead supplying a pushing medium such as pressurized air to push a residual amount of paint through the paint feed line to the spray nozzle. The method also involves introducing a shuttle element or separating element into the paint feed line between the residual paint and the pushing medium while the residual paint is being pushed through the paint feed line by the pushing medium, and the step of removing the separating element from the paint feed line or otherwise providing for fluid flow past the separating element before the separating element reaches the atomizing spray nozzle.

The separating element is substantially form-stable and provides a good seal between the residual paint and the pushing medium when the separating element is being pushed through the paint feed line. Thus, it is possible to achieve a highly accurate or exact separation between the still-usable residual paint and the pushing medium. Throughout this specification, the terms "painting" and "paint" will be used for simplicity and without limitation to refer generally to the application of any type of coating material, such as paint, lacquer, polymeric coatings, clear-coat, varnish, stain, wax, and the like, for example. Also throughout this specification, the pushing medium may generally be any known flushing medium and/or pressurized gas, whereby the flushing medium is a liquid solvent such as water or an appropriate chemical solvent for the paint being used, and the pressurized gas is pressurized air or some other dry gas. The flushing medium may be delivered in any known manner, for example a pulsated flushing medium and pressurized air in combination.

The above objects have further been achieved in an apparatus according to the invention for carrying out the method. The apparatus includes a paint color switching device and an atomizing spray nozzle at the two opposite ends of a paint feed line, a first receiver station or parking station and a second receiver station or catching station interposed in the paint feed line between the paint color switching device and the spray nozzle, and a separating element that is movably arranged in the paint feed line so as to be movable through the feed line between the first and second receiver stations.

Both of the receiver stations serve to receive the separating element in a chamber provided therein while ensuring that the paint can flow around or past the separating element without hindrance when this is necessary for carrying out the painting process. Thereby, the separating element can be regarded as being temporarily removed from the paint feed line when it is received in the respective chambers of the respective receiver stations. Particularly, during the normal painting process, as the paint or other coating material is being supplied through the paint feed line, the separating element is held by an active holding element in the first receiver station, i.e. the upstream receiver station located closer to the paint supply. When the residual paint is to be pushed out of the paint feed line by the separating element cooperating with a pushing medium such as pressurized air, then the separating element is released from the first receiver station and introduced into the paint feed line so as to separate the pushing medium from the residual paint, and the separating element is then pushed downstream until it is received in the second receiver station or catching station located closer to the spray nozzle.

The motion of the separating element and its arrival in the second receiver station is monitored or detected by sensors, so that the painting process can be terminated with great precision when substantially all of the residual paint has been pushed out of the paint feed line, and before the pushing medium reaches the spray nozzle. Then the separating element is retained in the second receiver station or catching station while the pressurized air and/or a flushing medium is caused to flow past the separating element and out through the spray nozzle, for example for the purpose of completely cleaning or flushing out the feed line and the nozzle. Thereafter, a flushing medium or pressurized air is used to push the separating element out of the catching station, back through the paint feed line, and finally into the first receiver station or parking station, where it is once again positively fixed or held by an active movable holding element. At this point, the equipment can be further flushed with pressurized air and/or a flushing medium in a forward or backward direction if desired, or is ready to begin a new paint application cycle with a different color or type of paint.

BRIEF DESCRIPTION OF THE DRAWINGS

The single FIGURE shows a simplified schematic diagram of the painting apparatus.

In order that the invention may be clearly understood, it will now be described in connection with an example embodiment, with reference to the single accompanying drawing FIGURE, which is a simplified schematic diagram showing only components that are important for understanding the present description. It should be understood that a complete operable coating apparatus would typically be expected to include additional components, whereby these additional components and their arrangement are generally known in the art. Such components have been omitted from the single drawing FIGURE for purposes of simplicity and overall clarity of the drawing.

DETAILED DESCRIPTION OF PREFERRED EXAMPLE EMBODIMENTS AND OF THE BEST MODE OF THE INVENTION

In the illustrated example embodiment, a painting apparatus 1 comprises a paint color switching device 2 including a plurality of paint supply lines 3, 4, 5 and 6 that are adapted to be respectively connected to paint supply containers containing different colors of paint. A respective control valve 7 is interposed in each one of the paint supply lines 3 to 6, whereby respective selected ones of the paint supply lines 3 to 6 can be selectively connected to a paint feed line 8. The paint color switching device 2 further includes a flushing medium line 11 with an interposed non-return valve 11A and an interposed control valve 11B, as well as a pressurized air line 12 with an interposed non-return valve 12A and an interposed non-return valve 12B. Through these control valves 11B and 12B, the flushing medium line 11 and the pressurized air line 12 can be selectively connected to the paint feed line 8 for respectively introducing a liquid flushing medium such as water or a solvent, or for introducing pressurized air, respectively, into the paint feed line 8.

The paint feed line 8 includes three sections 20A, 20B and 20C connected in series from the paint color switching device 2, which is connected at a proximal or inlet end 13 of the paint feed line 8, to an atomizing paint spray nozzle 10, which is connected at the opposite distal end 9 of the paint feed line 8. The spray nozzle 10 may, for example, be a paint spray gun that is used to spray the paint or other coating material onto the intended workpiece. Instead of the spray nozzle 10, the apparatus may include any other type of paint applicator, such as a paint roller with a paint feed system.

When it is intended to end the application of a first type or color of paint in a first paint application cycle, and instead switch to a second type or color of paint in a second paint application cycle, a residual amount of the first paint is present in the paint feed line 8 leading to the spray nozzle 10. To reduce the wasting of this residual paint, especially when the feed line 8 between the color switching device 2 and the spray nozzle 10 is relatively long, e.g. greater than 1 meter, the invention provides that the residual paint is used to the greatest possible extent in the normal painting process. In other words, the greatest possible portion of the residual paint, and preferably at least 90% or even more than 95% of the total residual paint, is to be pushed through the paint feed line 8 and sprayed through the spray nozzle 10 onto the workpiece before terminating a first paint application cycle prior to beginning a next successive paint application cycle.

In order to achieve this, the inventive apparatus further includes a shuttle element or separating element 15 arranged to be movable through the paint feed line 8, and particularly the middle section 20B of the paint feed line 8, between a first receiver station or parking station 14 and a second receiver station or catching station 18 interposed in the paint feed line 8 between the color switching device 2 and the spraying nozzle 10. Particularly, the parking station 14 is interposed between the two feed line sections 20A and 20B as close as possible to the inlet end 13 of the paint feed line 8 connected to the color switching device 2, while the catching station 18 is interposed between the two feed line sections 20B and 20C as close as practically possible to the distal end 9 of the paint feed line 8 to which the spray nozzle 10 is attached.

During the normal paint spraying process, the separating element 15 is held in the parking station 14 while the paint flows around or past the separating element 15 through the parking station 14 and through the paint feed line 8. Then, when a respective paint color cycle is to be ended in order to switch to a different paint color, the supply of paint is terminated by closing the corresponding control valve 7, and a pushing medium such as a flushing medium from the line 11 or pressurized air from the line 12 is introduced through the correspondingly opened valve 11B or 12B into the paint feed line 8 in order to push the residual paint out of the paint feed line 8 and out through the spray nozzle 10. At this time, the separating element 15 is released from the parking station 14 so that it enters the middle section 20B of the paint feed line 8 to form a positive physical separation between the pushing medium and the residual paint.

To ensure that the separating element 15 properly separates the pushing medium from the residual paint, the release of the separating element 15 from the parking station 14 can be triggered by a control unit C to coincide with the opening of the respective control valve 11B or 12B, or at predefined point, e.g. a short delay time period, thereafter. When the separating element 15 is released from the parking station 14, it is pushed into and through the central section 20B of the paint feed line 8 by the pushing medium, while the separating element 15 in turn pushes the column of residual paint ahead of itself.

To ensure that the paint can flow past the separating element 15 without hindrance in the parking station 14 in a direction toward the spray nozzle 10 during the usual painting process, the parking station 14 encloses a chamber 16 which has a diameter or cross-sectional area larger than the separating element 15 itself, and larger than the internal cross-sectional area of the paint feed line 8. Furthermore, the parking station 14 comprises an actuatable holding element 17 that selectively holds the separating element 15 in the chamber 16 to prevent the flow of paint from pushing the separating element 15 into the middle section 20B of the paint feed line 8 during normal painting operation. This holding element 17 may be any positively actuatable element that would block the passage or otherwise restrain the separating element 15. For example, the holding element 17 may comprise a shiftable locking bolt or locking pin actuated by a pneumatic cylinder or a solenoid, so as to block the path of the separating element 15 in the chamber 16, or to engagingly hold the separating element 15. Alternatively, an electromagnet arrangement or the like can be used as a holding element 17.

Once the holding element 17 releases the separating element 15, the separating element 15 is pushed into the middle section 20B of the paint feed line 8 by the medium supplied from the color switching device 2.

At this time, the separating element 15 moves through the middle section 20B of the paint feed line 8 until it reaches the catching station 18, where it enters into a chamber 19 enclosed by the catching station 18. The internal cross-sectional area of the chamber 19 is larger than the outer diameter or cross-sectional area of the separating element 15 and also larger than the internal diameter or internal cross-sectional area of the middle section 20B of the paint feed line 8. Thus, the flushing medium can continue to flow around or past the separating element 15 through the catching station 18 so as to push the residual paint through the terminal or distal section 20C of the paint feed line 8 and out through the atomizing spray nozzle 10, if desired, under control of the controller C as will be described below.

The internal diameter or internal cross-sectional area of this terminal section 20C of the paint feed line 8 is smaller than the outer diameter or cross-sectional area of the separating element 15, so that the separating element 15 cannot enter and pass into the paint feed line section 20C. As an alternative to the simple provision of different cross-sectional areas or diameters of the components, it is also possible to provide any desired form or configuration of stop in the catching station 18 in order to restrain and prevent the separating element 15 from travelling further in the direction toward the atomizing spray nozzle 10, i.e. to prevent the separating element 15 from passing into the feed line section 20C.

Downstream from the catching station 18, in the ordinary paint flow direction, i.e. between the catching station 18 and the spray nozzle 10, a connector and valve arrangement 21 is interposed in or connected to the terminal section 20C of the paint feed line 8. The connector and valve arrangement 21 includes respective control valves 22 and respective non-return valves 23 arranged in series for selectively connecting a flushing medium line 24 or a pressurized air line 25 to the distal or terminal section 20C of the paint feed line 8. By actuating the respective selected one of the control valves 22, a flushing medium or pressurized air as desired can be introduced into the terminal section 20C of the paint feed line 8.

On the one hand, this flushing medium or pressurized air provided from the arrangement 21 will flow out through the spraying nozzle 10 if this nozzle is actuated so as to completely clear out and flush out any remaining paint from the components downstream of the connector and valve arrangement 21. On the other hand, the flushing medium or pressurized air will also flow back through the paint feed line 8 and through the catching station 18 and parking station 14 and finally to the paint color switching device 2, whereby the flushing medium and/or pressurized air, as well as any remaining paint residues that have been flushed out of the system, can be drained by opening a drain valve 35 or the like. This reverse flow of the flushing medium and/or pressurized air from the connector and valve arrangement 21 back through the paint feed line 8 in the direction toward the color switching device 2 also serves to push the separating element 15 back from the catching station 18 through the feed line section 20B and into the parking station 14. Once it is in the parking station 14, the separating element 15 is prevented from travelling further in the direction toward the color switching device 2, i.e. into the paint feed line section 20A, by a separating element stop 26 provided in the parking station 14.

A paint dosing device 27 connected in parallel with a bypass line 28 having a control valve 29 interposed therein is arranged m between the connector and valve arrangement 21 and the spray nozzle 10. This dosing device 27 can have any configuration and operation known to persons skilled in the art, for carrying out the function of dosing the quantity and/or flow rate of paint being applied through the spray nozzle 10.

In order to monitor the location and motion of the separating element 15, and particularly to detect the presence of the element 15 in the parking station 14 and/or in the catching station 18, as well as the correct direction of travel and a plausible travel velocity of the separating element 15 through the middle feed line section 20B, respective sensors 30 are arranged in the parking station 14 and/or the catching station 18, as well as at locations along the middle feed line section 20B, and particularly at locations near the parking station 14 and the catching station 18. The sensors 30 are each connected for signal transmission to a controller C that controls the operation of the apparatus 1. Namely, the controller C monitors the operation of the apparatus 1, accepts input commands from the operator of the apparatus, and sends appropriate control signals to the various control valves 7, 11B, 22, 29, and 35, as well as the actuator of the holding element 17 in the parking station 14, the dosing device 27, and/or even the spray nozzle 10, as necessary. The signal transmitting connections between the controller and the control valves have been omitted from the drawing Figure for the sake of clarity, but all signal transmission connections can be embodied by any known means.

By detecting the location and the travel velocity of the separating element 15 as it travels from the parking station 14 to the catching station 18 at the end of a paint color cycle, the controller C is able to determine with great precision when the separating element 15, forming the boundary between the pressurized air pushing medium and the residual paint will reach and then actually does reach the catching station 18. This information then allows the controller C to discontinue the flow of pushing medium and/or stop the dosing arrangement 27 at substantially exactly the right time to ensure that substantially all of the pure unadulterated residual paint from the paint feed line 8 has been sprayed out through the spray nozzle 10 for the ordinary painting operation, without spraying any of the pushing medium out through the spray nozzle 10. In this manner, the utilization of the residual paint can be maximized while still ensuring the avoidance of painting defects.

So that the sensors 30 are able to reliably detect the presence and motion of the separating element 15, the separating element 15 may comprise a metallic core that can be detected by various types of known magnetic or electromagnetic sensors, for example. Furthermore, the separating element 15 is substantially form-stable and rigid, and may comprise outwardly protruding sealing lips in order to achieve the desired sealing function between the pushing medium and the residual paint as it passes through the paint feed line 8. Thus, the separating element is a relatively short rigid body that fits into the middle section 20B of the paint feed line 8 in a form-fitting manner. Thereby, the separating element 15 reliably prevents a transference or intermingling of the pushing medium into the residual paint on the opposite side of the separating element 15. While some paint residue may be on the upstream side of the separating element 15, i.e. between the separating element 15 and the paint color supply switching device 2, where it intermingles with the pushing medium, the important point is that the residual paint on the downstream side of the separating element 15 remains unadulterated so that it can safely be sprayed out of the spray nozzle 10 without causing painting defects on the workpiece.

For the sake of clarification, it should be understood that only a single separating element 15 is needed or provided in the present apparatus. This single separating element 15 is located either in the parking station 14 or in the catching station 18, or in transit through the paint feed line section 20B between the two stations 14 and 18, as described above. For the sake of illustrating the two end positions of the single separating element 15, the drawing Figure shows the separating element 15 both in the parking station 14 and in the catching station 18, but this should not be taken to mean that there are two separating elements.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method of applying at least one coating material onto at least one workpiece using a coating material application system including a coating material supply device, a coating material applicator, a feed line connected between said supply device and said applicator, a substantially form-stable separating element adapted to be pushed through said feed line, and first and second receiver stations that are interposed in said feed line and that respectively enclose first and second chambers which are in flow-through communication with said feed line and which are respectively dimensioned to be able to receive said separating element therein while allowing fluid flow through said respective chamber past said separating element, said method comprising the following steps:

a) supplying a first coating material from said coating material supply device, flowing said first coating material through said feed line to said coating material applicator, and applying said first coating material from said applicator onto at least one workpiece, while holding said separating element in an initial position in said first chamber and flowing said first coating material past said separating element through said first chamber;

b) discontinuing said supplying of said first coating material from said supply device such that a residual amount of said first coating material is in said feed line between a first side of said separating element in said initial position and said coating material applicator;

c) supplying a first pushing medium into said feed line between said coating material supply device and a second side of said separating element opposite said first side;

d) releasing said holding of said separating element in said first chamber and continuing to supply said first pushing medium into said feed line, so as to push said separating element through said feed line toward said coating material applicator while pushing said residual amount of said first coating material ahead of said separating element through said feed line toward said coating material applicator, and catching said separating element in said second chamber and preventing said separating element from moving further toward said coating material applicator than a final position in said second chamber;

e) terminating said step d), wherein said separating element is located in said final position when said step d) is terminated; and f) moving said separating element back through said feed line to return said separating element from said final position to said initial position.

2. The method according to claim 1, wherein said step d) further comprises causing at least a portion of said residual amount of said first coating material being pushed ahead of said separating element to be emitted out of said applicator and applied onto said first workpiece, without allowing any of said first pushing medium to be emitted out of said applicator.

3. The method according to claim 2, wherein said portion is at least 95% of said residual amount recited in said step b).

4. The method according to claim 1, wherein said first coating material is a paint, said applicator comprises a spray nozzle, and said first pushing medium comprises at least one of a pressurized gas and a liquid flushing medium.

5. The method according to claim 1, wherein said step of moving said separating element back through said feed line comprises supplying a second pushing medium into said feed line between said first side of said separating element and said applicator so as to push said separating element back through said feed line toward said coating material supply device until said separating element reaches said initial position.

6. The method according to claim 5, after said separating element has been moved back through said feed line to said initial position, further comprising repeating said steps a), b), c), and d) using a second coating material instead of said first coating material, wherein said second coating material is different from said first coating material.

7. The method according to claim 6, after said separating element has been moved back through said feed line to said initial position and before repeating said steps a), b), c), and d), further comprising flushing out said feed line with a flushing medium and then blowing said flushing medium out of said feed line using a pressurized gas.

8. The method according to claim 1, wherein said terminating of said step d) is carried out once said separating element reaches said final position in said second chamber of said second receiver station.

9. The method according to claim 1, further comprising a step of removing said separating element from said feed line before said separating element reaches said applicator during said step d).

10. The method according to claim 1, wherein said separating element is adapted to be form-fitting and substantially sealing relative to said feed line as said separating element is pushed through said feed line in said step d).

11. A coating material application system comprising:

a coating material supply switching device;

a coating material applicator;

a coating material feed line connecting said supply switching device to said applicator;

first and second receiver stations interposed in said feed line, with said first receiver station closer to said supply switching device and said second receiver station closer to said applicator;

a separating element arranged to be received in and movable through said feed line between said first and second receiver stations;

a first pushing medium line connected to at least one of said coating material supply switching device, said first receiver station, and said coating material feed line between said first receiver station and said coating material supply switching device, wherein said first pushing medium line is adapted to supply a pushing medium into said feed line so as to push said separating element through said feed line from said first receiver station to said second receiver station; and a second pushing medium line connected to at least one of said coating material applicator, said second receiver station, and said feed line between said second receiver station and said coating material applicator, wherein said second pushing medium line is adapted to supply a pushing medium into said feed line so as to push said separating element through said feed line from said second receiver station to said first receiver station;

wherein said first receiver station comprises a first housing enclosing therein a first chamber that is in fluid flow connection with said feed line, a first stop member that is arranged and adapted to block said separating element against moving out of said first chamber toward said coating material supply switching device, and a selectively actuatable holding element arranged and adapted to selectively hold said separating element against moving out of said first chamber toward said coating material applicator and selectively release said separating element to enable said separating element to move out of said first chamber toward said coating material applicator; and wherein said second receiver station comprises a second housing enclosing therein a second chamber that is in fluid flow connection with said feed line, and a second stop member that is arranged and adapted to block said separating element against moving out of said second chamber toward said applicator, without anything preventing said separating element from moving out of said second chamber into said feed line toward said supply switching device.

12. The coating material application system according to claim 11, wherein said coating material applicator comprises a spray nozzle.

13. The coating material application system according to claim 11, wherein said coating material supply switching device comprises a plurality of coating material supply control valves; and wherein said system further comprises:

a first pushing medium control valve interposed in said first pushing medium line, a second pushing medium control valve interposed in said second pushing medium line, a plurality of sensors adapted to sense said separating element at locations selected from said first receiver station, said second receiver station, and said feed line between said first and second receiver stations, and a common control unit connected for signal transmission with all of said valves and said sensors.

14. The coating material application system according to claim 11, wherein said separating element comprises at least a core comprising a material adapted to be detected by a sensor.

15. The coating material application system according to claim 11, further comprising a valve arrangement interposed in said feed line between said second receiver station and said applicator, wherein said valve arrangement includes a flushing medium control valve adapted to selectively connect a flushing medium line to said feed line and a pressurized air control valve adapted to selectively connect a pressurized air line to said feed line; and further comprising a dosing arrangement interposed in said feed line between said valve arrangement and said applicator, wherein said dosing arrangement includes a dosing device, and a bypass control valve interposed in a bypass line that is connected in parallel with said dosing device.

* * * * *

UNITED STATES PATENT AND TRADEMARK OFFICE
CERTIFICATE OF CORRECTION

PATENT NO. : 6,090,450

DATED : July 18, 2000

INVENTOR(S) : Kahmann et al.

It is certified that error appears in the above-identified patent and that said Letters Patent is hereby corrected as shown below:

On the Title Page

Under [57] ABSTRACT,
line 24, after "station.", insert --The utilization of the residual paint in the feed line can be maximized.--.

Signed and Sealed this

Third Day of April, 2001

*Attest:*

Nicholas P. Godici

NICHOLAS P. GODICI

*Attesting Officer*

*Acting Director of the United States Patent and Trademark Office*